US005321928A

United States Patent [19]

Warneke

[11] Patent Number: 5,321,928

[45] Date of Patent: Jun. 21, 1994

[54] STEEL COFFER FOR CEILING AND/OR WALL STRUCTURES OF BUILDINGS, HOUSING UNITS, INTERIOR AND EXTERIOR STRUCTURES OF SHIPS

[76] Inventor: Horst Warneke, Am Osterfeld 37, D-2807 Achim, Fed. Rep. of Germany

[21] Appl. No.: 690,887

[22] PCT Filed: Oct. 11, 1990

[86] PCT No.: PCT/EP90/01706

§ 371 Date: Jun. 13, 1991

§ 102(e) Date: Jun. 13, 1991

[87] PCT Pub. No.: WO91/05925

PCT Pub. Date: May 2, 1991

[30] Foreign Application Priority Data

Oct. 13, 1989 [DE] Fed. Rep. of Germany ..... 3934257

[51] Int. Cl.[5] ..... E04C 2/08

[52] U.S. Cl. ..... 52/581; 52/630; 52/283; 52/483; 52/672

[58] Field of Search ..... 52/630, 126.6, 283, 52/483, 763, 777, 319, 338, 581, 443, 670, 672; 114/76, 85, 88

[56] References Cited

U.S. PATENT DOCUMENTS

| | | | |
|---|---|---|---|
| 1,014,617 | 1/1912 | White | 52/672 |
| 1,796,048 | 3/1931 | Robinson | 52/206 |
| 1,986,998 | 1/1935 | Burgess et al. . | |
| 3,093,216 | 6/1963 | Dunham | 52/581 X |
| 4,198,795 | 4/1980 | Barnidge | 52/581 X |
| 4,640,073 | 2/1987 | Blecher | 52/403 |
| 4,691,493 | 9/1987 | Larsen | 52/581 X |
| 4,833,845 | 5/1989 | Brückner et al. | 52/126.6 |
| 4,922,670 | 5/1990 | Naka et al. | 52/126.6 |

FOREIGN PATENT DOCUMENTS

| | | | |
|---|---|---|---|
| 1788860 | 3/1959 | Fed. Rep. of Germany . | |
| 1509025 | 10/1970 | Fed. Rep. of Germany . | |
| 1484938 | 5/1972 | Fed. Rep. of Germany . | |
| 2439071 | 2/1976 | Fed. Rep. of Germany . | |
| 8616637.9 | 10/1986 | Fed. Rep. of Germany . | |
| 0695439 | 5/1930 | France . | |
| 0809334 | 12/1936 | France | 52/471 |
| 1132795 | 11/1956 | France | 52/584 |
| 1414261 | 11/1964 | France . | |
| 2470825 | 12/1979 | France . | |
| 410347 | 10/1966 | Switzerland . | |
| 0865443 | 4/1961 | United Kingdom . | |

*Primary Examiner*—Carl D. Friedman
*Assistant Examiner*—Robert J. Canfield
*Attorney, Agent, or Firm*—Browdy and Neimark

[57] ABSTRACT

The steel coffer is provided in the form of a box-like coffer element (1) of great load-bearing capacity, having a wall (2), flat per se, and a circumferential, multiply-folded edge section (3), which has stiffening sections (4) fastened underneath the coffer wall (2), has perforations (5) and connecting holes (6) in the circumferential edge section (3) and has, in the corners, notches (7) for folding the edge sections (3) and for insertion of the supports (8).

11 Claims, 5 Drawing Sheets

B - B

FIG. 3
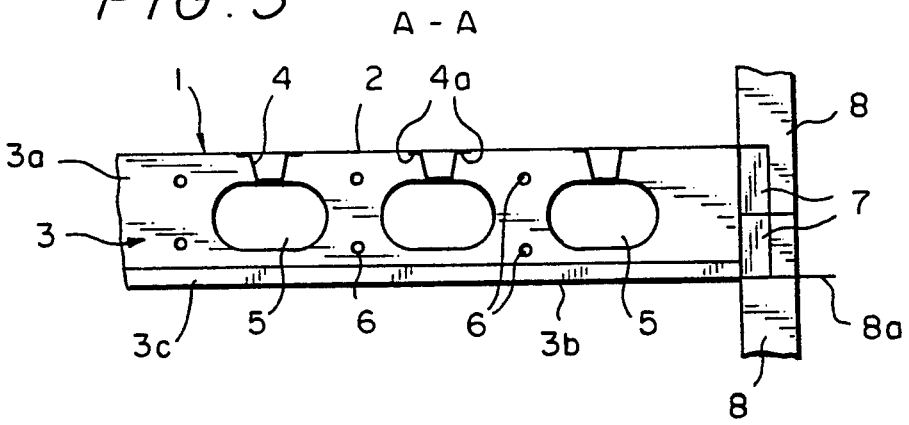
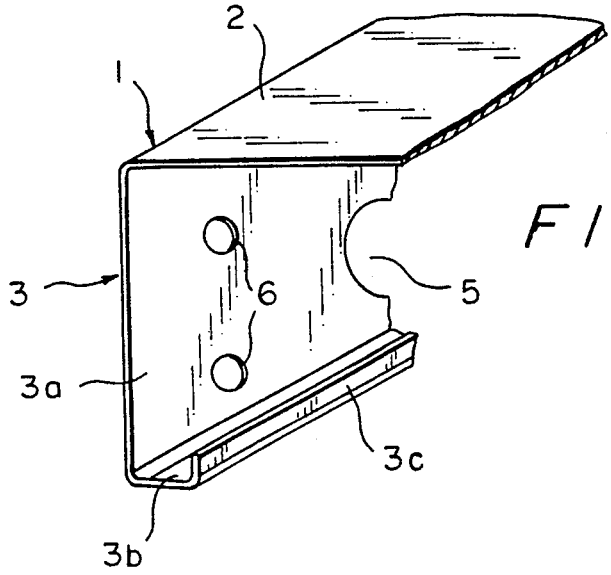
FIG. 4
FIG. 10
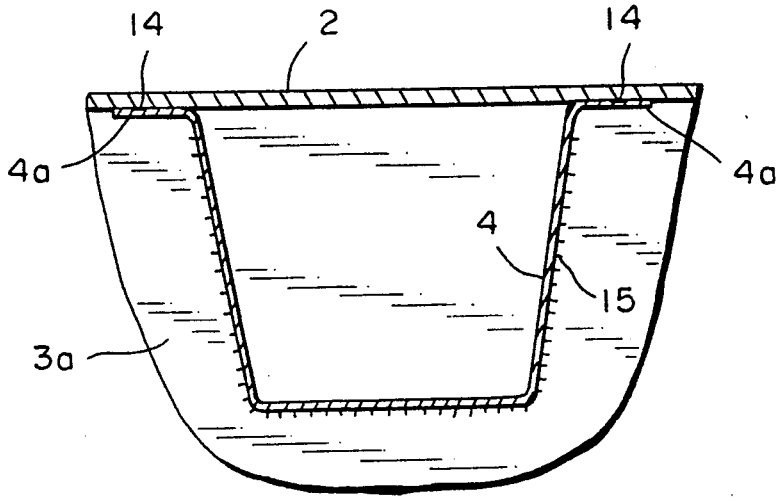

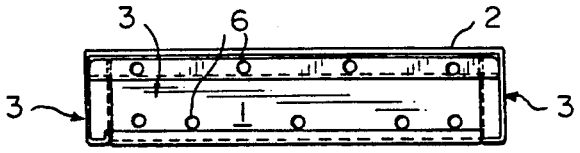
FIG. 6
FIG. 5
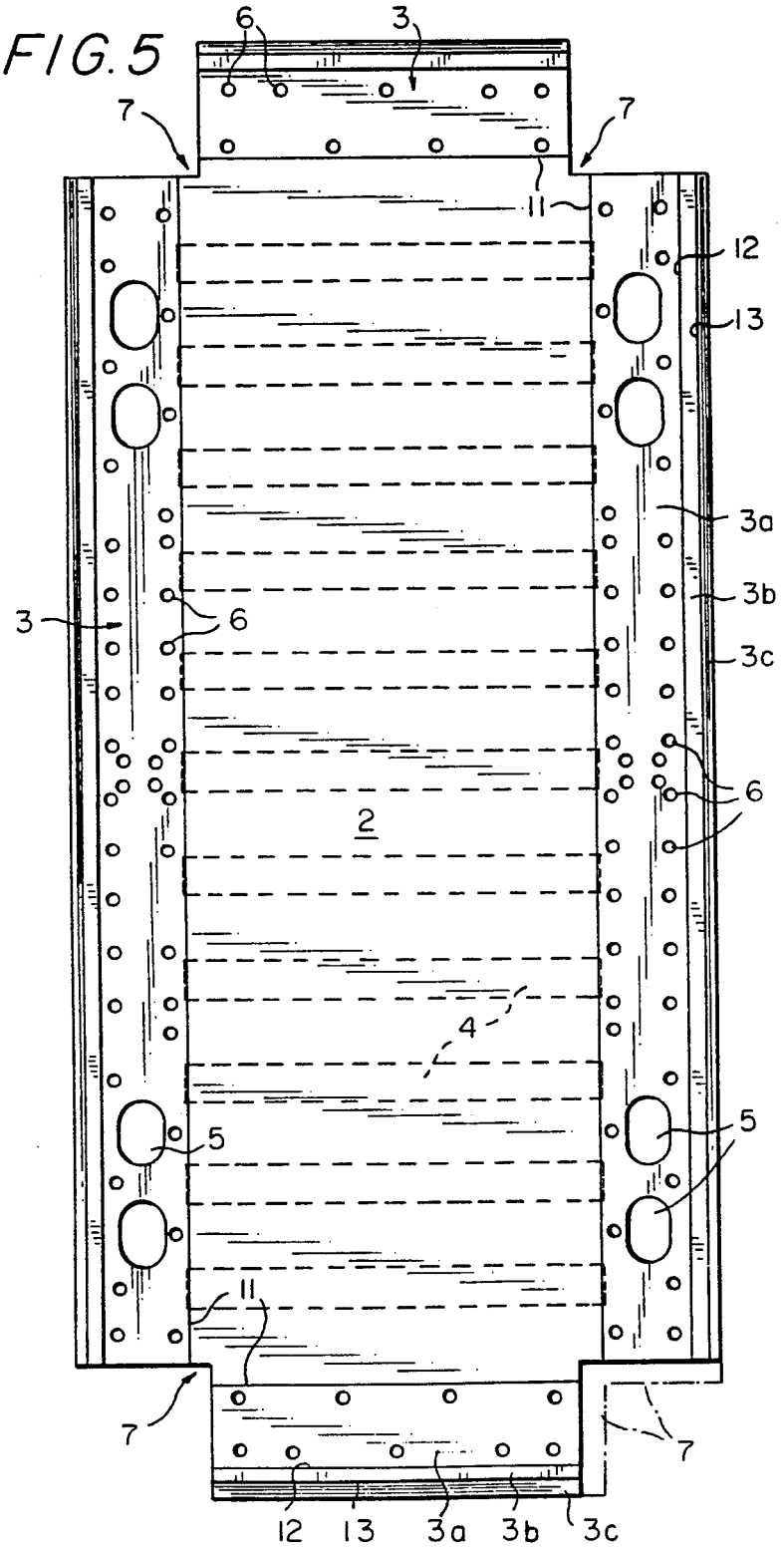
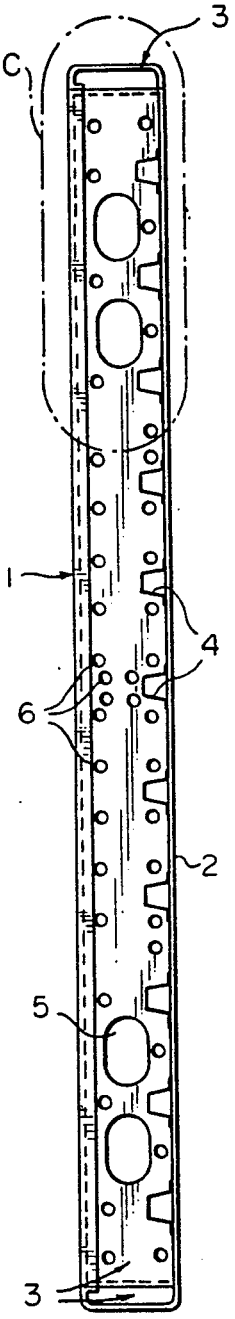
FIG. 7

STEEL COFFER FOR CEILING AND/OR WALL STRUCTURES OF BUILDINGS, HOUSING UNITS, INTERIOR AND EXTERIOR STRUCTURES OF SHIPS

BACKGROUND OF THE INVENTION

The invention relates to a steel coffer for ceiling and/or wall structures, in particular for interior and exterior structures of ships or transportable or easily movable building and housing units.

Steel bulkheads, which in their disposition are essentially used as fire protection or which determine structural stability, have long been known as vertical or horizontal boundaries for spaces in ship construction.

The structural goal is to bridge as large as possible support distances, i.e. bearing widths, and to reduce the number of structural support columns for ceiling structures. At the same time, there is a requirement of creating space for installation of utilities, such as ventilation, water, heating, fire-fighting devices, etc.

For example, steel bulkheads are used as ceiling panels with a sheet metal thickness of 6 to 7 mm, instead of using the required minimum of 5 mm, because the subsequent welding operations cause too great an amount of warping and require appropriate finishing work.

Long stalk, T-shaped support pieces are placed underneath and welded in accordance with static calculations. The free areas of the plates of sheet metal created by this are stiffened by means of special shipbuilding sections. This structure is welded together into building segments which can be moved by a crane and are possibly used more than once in order to create optimum welding positions and prerequisites.

The segments are later combined with other segments and welded together.

A common problem is to make do, along with the least amount of steel used, with as little as possible bracing and twisting of the structure, because of the considerable welding work required.

OBJECTIVES AND SUMMARY OF THE INVENTION

It is the object of the invention to provide a steel coffer with high load-bearing capacity in the form of a simple, cost-effective prefabricated structural element with optimal weight, in connection with which welding work can be considerably reduced, which represents a low-warping structure which can be connected with the same type of plates and supports in a modular construction and which is provided with installation aids and perforations for utilities for forming ceiling and/or wall structures.

The basic structural arrangement of the clear, spanned surface and the corresponding supports is not changed by the steel coffer in accordance with the invention in the form of a folded and stiffened coffer element.

The clear spanned area between four supports is formed by a sheet steel plate made of sheets of 5 mm thickness. The approximately 450 mm high edge sections between the supports are formed by means of bending the sheet steel plate. One or two further folds are formed on the folded edge section to use it statically in an advantageous manner.

This repeatedly folded edge section extends over all four edge areas of the sheet steel plate and forms the bearers of the steel coffer.

The required notches for folding the formed edge sections and to receive the supports are cut out of the corners of the sheet steel plate. The required perforations for the subsequent installation are made in the edge sections by means of stamping techniques, flame cutting, lasers or the like.

Bores are furthermore made in the folded support sections of the sheet steel plate, by means of which adjacent sheet steel coffers are combined at their folded edge sections by means of riveted, screw or bolt connections. For the static improvement of the adjacent steel coffers it is possible to make a minimum of welded connections at suitable points between the finished coffers.

For stiffening the clear area surfaces between the supports, a plurality of stiffening sections, made by means of spot welding techniques or point fusion welding or welding beads, are fixed below the coffer wall and/or on the edge sections in the guide strips and/or at the front ends of the stiffening sections, because of which warping is reduced to a minimum.

A steel coffer of this type is simple in its structural design, cost-effective in respect to manufacture and has only a minimum of welding points, because of which warping and adjustment work are prevented to the greatest extent possible.

This steel coffer has high stability at any given sheet thickness, is self-supporting per se because of the folded edge sections and stiffening sections and has a high load-bearing capacity along with comparatively great bearing widths.

In accordance with the modular concept the steel coffer can easily be combined with a plurality of coffers at the final assembly point and can be fixed with its bearing edge sections on supports and fastened inside the notches on the supports by welding, riveting, bolting, casting compound or the like.

This pre-fabricated steel coffer furthermore contains all required installation aids and perforations for subsequent assembly operations as well as for placement of plumbing and wiring of different types.

The area of use of this steel coffer is intended to be in particular shipbuilding and, in connection with transportable or movable building and housing units, as ceiling and/or wall elements with high load-bearing capabilities. However, this steel coffer can also be employed in other fields of load-bearing and self-supporting light steel construction.

BRIEF DESCRIPTION OF THE DRAWINGS

An exemplary embodiment of a variation of the invention is shown in the drawings and will be described in detail below.

FIG. 3 is a longitudinal section of a partial area of the steel coffer along the line A—A of FIG. 1., FIG. 4 is a perspective view of the fold area of the steel coffer, FIG. 5 is a view from below of the stamped sheet metal plate with folding lines and notches on the corners of the steel coffer, FIG. 6 is a front view of the steel coffer formed from the sheet metal plate and stiffened, FIG. 7 is a longitudinal lateral view of the same steel coffer, FIG. 9 is a top view of the notch area at the corner of the steel coffer with the angle bracket welded in, FIG. 10 is a cross-sectional view of a stiffening section fastened in the folded steel coffer by welding.

DETAILED DESCRIPTION OF THE PREFERRED EMBODIMENTS

Figure 1:
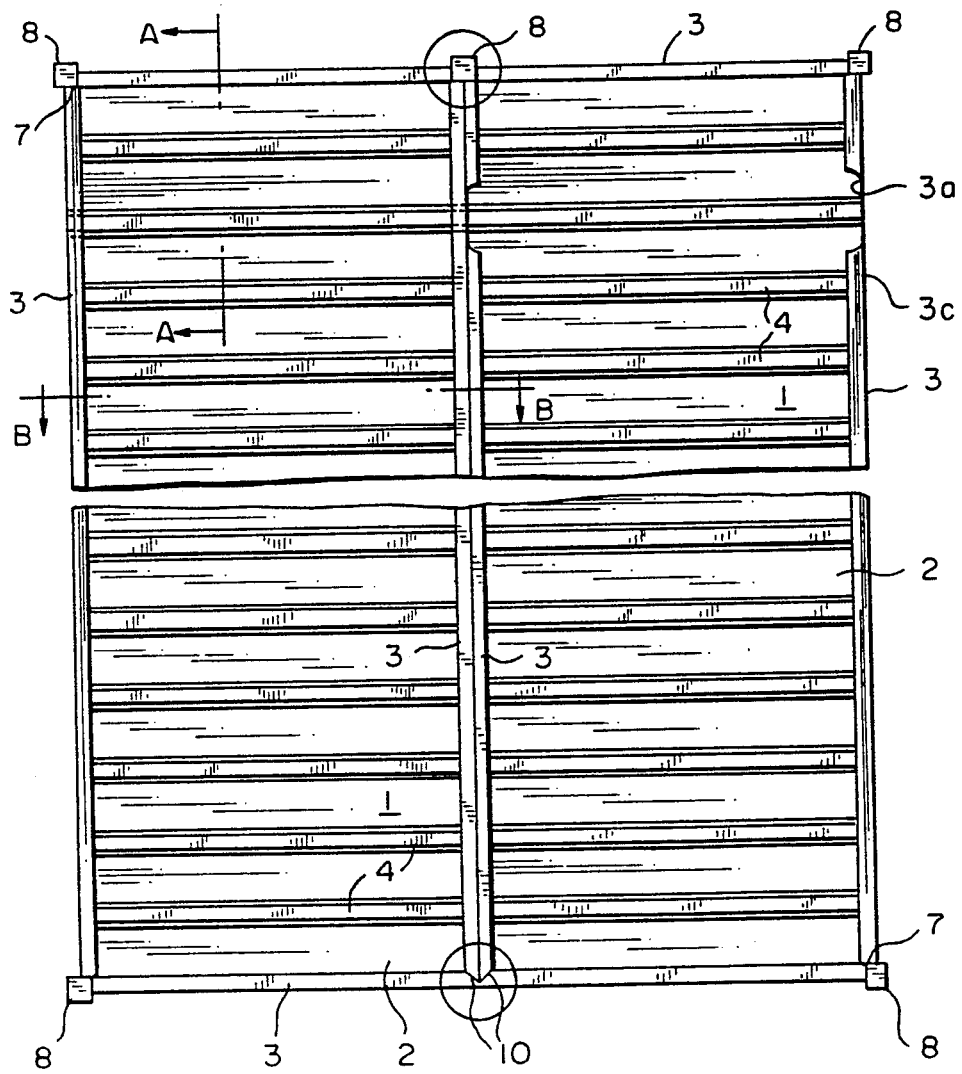
FIG. 1 is a view from below of two steel coffers disposed next to each other, connected and fixed on the supports.
Figure 2:
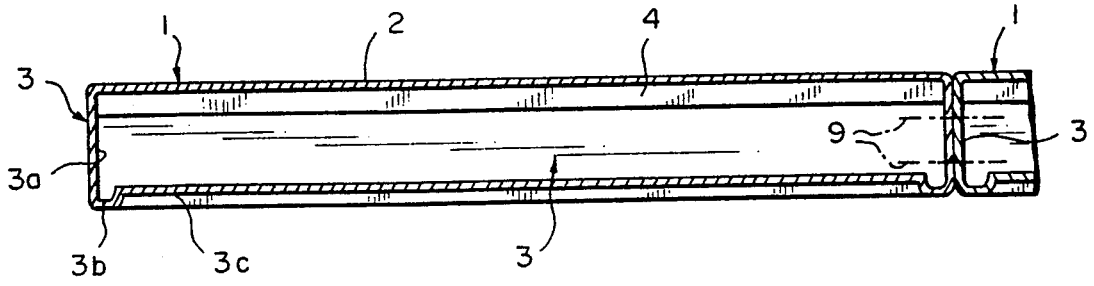
FIG. 2 is a cross-sectional view along the line B—B in FIG. 1 of a steel coffer with an adjoining adjacent steel coffer.

The steel coffer (1), used in particular for interior or exterior structures of ships, or other objects on land made of steel structures, or transportable or easily movable housing or shed units on the basis of light steel construction, as well as other wall and/or ceiling structures, is formed by a box-shaped coffer element with walls (2), flat per se, and a circumferential edge section (3), multiply folded, with stiffening sections (4) fastened underneath the wall (2), with perforations (5) made in the circumferential edge section (3), with connecting holes (6) and notches (7), placed in the corners of the steel coffer (1) for folding the edge sections (3) and for inserting the supports (8).

In a preferred way the steel coffer (1)—the coffer element (1)—has a basically rectangular shape and shows on all four sides of the rectangle multiply folded edge sections (3) as the support of the coffer element (1) in the structural embodiment.

Figure 8:
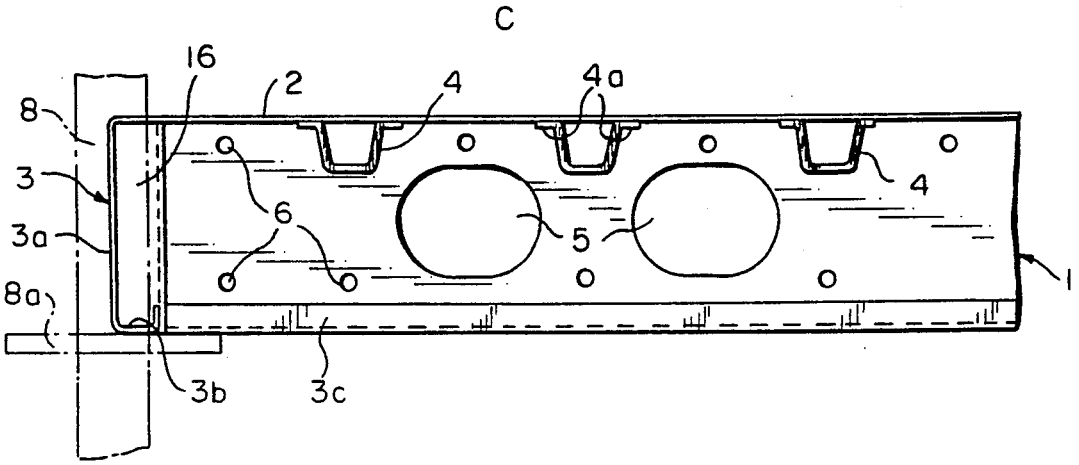
FIG. 8 is a lateral partial view of the steel coffer in accordance with the area C in FIG. 7.

Each edge section (3) has an L-shaped cross section and has a leg (3*a*) folded vertically in relation to the wall (2), an adjoining folded leg (3*b*) extending parallel to the wall (2), and an adjoining folded leg (3*c*) extending parallel to the leg (3*a*) and oriented in the direction of the wall (2). The vertical leg (3*a*) is longer than the leg (3*b*), and the latter in turn is longer than the leg (3*c*) (FIGS. 4 and 8).

For a connection with adjacent steel coffers, holes (6) in the shape of bores are provided in the folded legs (3) of the edge sections (3), through which rivets (9), screws, bolts or the like are inserted for connecting the coffers. Additionally, perforations (5) of the same or of different size and shape have been left in the vertical legs (3*a*) of the edge sections (3) for the subsequent installation of ventilation, heating, water or fire-fighting devices and the like. Preferably, the perforations (5) each have an oval shape or that of an oblong hole and are located underneath of or between the stiffening sections (4) (FIGS. 3 and 8).

One notch (7) each is provided in all four corners of the steel coffer (1), which makes possible the folding of the edge sections (3).

In the corner(s) where no supports are disposed, the vertical legs (3*a*) abut against each other, and each of the other two legs (3*b*, 3*c*) has a bevel cut (10) and is abutting in a miter joint. In the corner(s) were supports are provided, the notch (7) is larger in the direction of the wall (2) by one half of the support cross section, so that the supports (8) partially engage the wall (2) of the steel coffer (1) and the extending portion of the cross section of the supports (8) lies in the adjoining steel coffer (1) and its notches (7).

For example, the steel coffer (1) is provided with three larger notches (7) for disposing three supports (8), and the fourth corner is inserted in the notch (7) only as far as the folded lines (11) between the wall (2) and the vertical leg (3*a*) (see the dash-dotted lines in the right lower corner of FIG. 5), so that in this case the edge sections (3) adjoin and abut in a miter joint.

The stiffening sections (4) are fastened underneath the wall (2) of each steel coffer (1) at a distance parallel to each other and preferably extending crosswise to the longitudinal direction of the coffer, and extent over the entire width of the steel coffer (1) between the edge section (3). They have a hat-shaped or trapeze-shaped cross section and are connected by point fusion welding or resistance welding underneath the wall (2) by means of externally oriented fastening strips (4*a*).

In a preferred manner, the steel coffers (1) rest with their corner areas on support collars (8*a*) of the supports (8) (see FIGS. 4, 8 and 9) at a place where two or four coffers (1) adjoin and which are then screwed or riveted or welded to the supports (8) in the area of the notches (7).

Production of such a steel coffer (1) proceeds as follows:

A sheet metal plate (one-piece, or a sheet metal plate made from two plates connected by welding) is used as the basic unit, which is pre-fabricated, as far as its external shape and all required perforations (5) and holes (6) are concerned, by means of flame cutting techniques, laser techniques, stamping techniques or the like.

In FIG. 5 this sheet metal plate is shown with the notches (7), the stamped-out perforations (5) and the holes (6), and the folding edges (11, 12, 13) for the folding of the edge sections (3) are indicated by lines.

This prepared sheet metal plate is brought to the different deforming work stations via conveyors in order to obtain the previously described edge sections (3) (bearers/supports) by means of bending techniques. In this case the sheet metal plate remains in the horizontal position, while the bending machine forms the edge areas.

The prepared stiffening sections (4) for stiffening the coffer surface from its inside are inserted into the folded coffer (1) and are connected with the coffer wall (2) by point fusion welding (14) or resistance welding, and with the edge section legs (3*a*) by weld beads (15) on both long ends.

Figure 9:
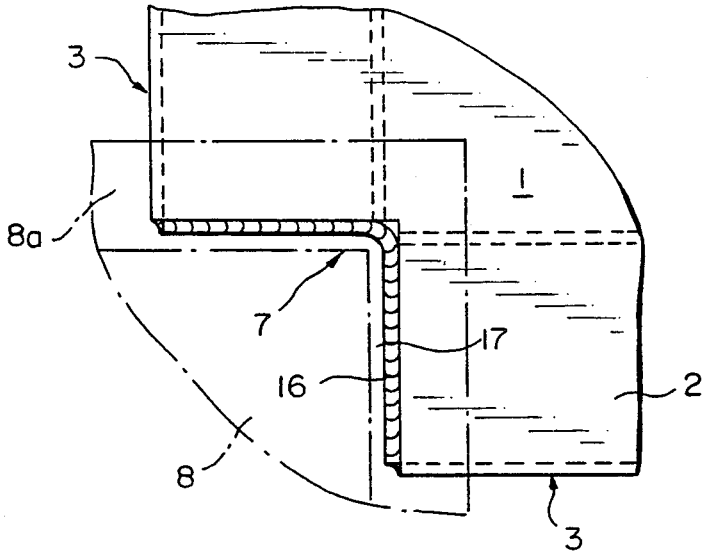

As shown in FIG. 9, it is possible to attach to all four notched corners (7) of the steel coffer (1) angle brackets (16) by welding, which close off the notches (7) towards the interior of the coffer, i.e. result in closed, recessed corners.

The steel coffer (1) is given an increased stability for transport by these welded-in corner brackets (16), and furthermore these corner brackets (16) provide connecting surfaces for a casting compound.

Figure 11:
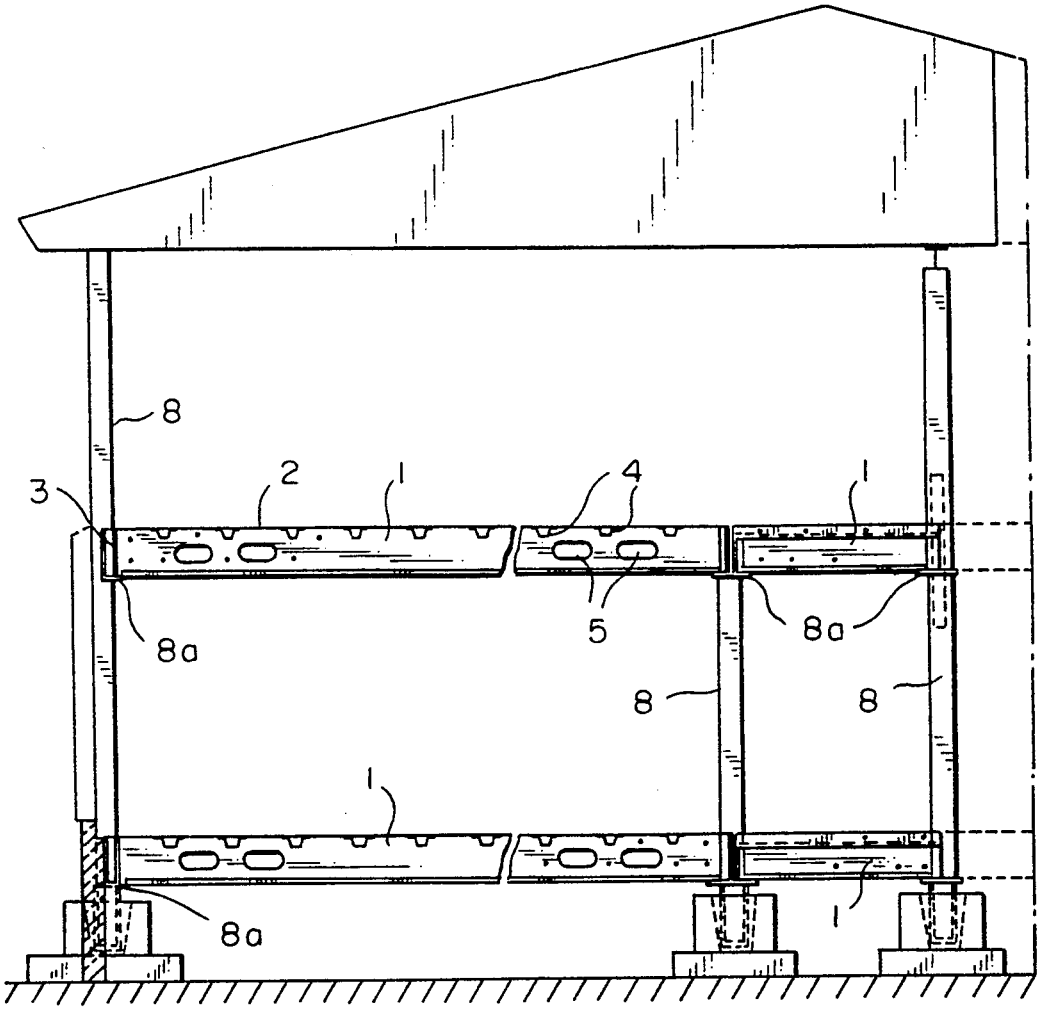
FIG. 11 is a schematic view of a partial area of a building with steel coffers fastened on supports and forming the ceiling of a building.

As shown in FIGS. 8 and 11, the steel coffers (1) supported on the support collars (8*a*) of the supports (8) surround the supports (8) by means of a gap (17) next to their corner brackets (16). A suitable casting compound, such as a resin, plastic, asphalt or the like, is introduced into this gap (17), which connects the support (8) over the entire height of the coffer (1) with its corner braces (16) and which simultaneously results in sound and oscillation insulation and damping.

FIG. 11 shows the use of the steel coffers (1) as ceiling elements in building construction.

The steel coffer (1) formed from the plate can be clearly seen in FIGS. 6, 7 and 8. To ease understanding, the stiffening sections (4), located on the inside and covered by the edge sections (3), are drawn in solid lines and, in the drawing of the plate in accordance with FIG. 5, the arrangement of the stiffening sections (4) is shown by dashed lines.

With the coffer (1) in accordance with the invention, sheet metal plates of arbitrary size up to the maximum commercially available size, for example length = 14000 mm × width B = 3000 mm, thickness of the sheet metal = 4 to 7 mm, are used, or also made by joining two commercially available sheet metal plates by a suitable welding process up to a maximum plate size of approximately 14000 mm × 6000 mm with the same thickness of the sheet metal, are notched at the corners of the plate and the edges of the plate are made by bending, and not by welding, into a sheet metal plate with formed edge sections (3) as supports. The clear surfaces of this sheet metal plate are stiffened by thin trapezoidal sheet metal sections (4). The connection is mainly made by spot welding.

Depending on the selection of the thickness of the sheet metal and the size of the plate, as well as the height of the folded supports (3), the manufactured steel coffer can take loads up to 1000 kg/m$^2$.

Thus the particular characteristic is the ability to provide, by means of the steel coffer, a bearing ceiling of steel for a floor, with formed-on supports (3) for useful loads, such as required in housing construction and commercial buildings, having bearing widths up to a maximum of approximately 13000 mm × 5000 mm.

This construction is something special, because no technical methods have been known up to now for manufacturing such steel coffers (1) by means of deformation techniques applied to the edge areas.

I claim:

1. A steel coffer for ceiling and/or wall structures of buildings, housing units, interior and exterior structures of ships, said steel coffer comprising:

a box-shaped coffer element (1);

said box-shaped coffer element having a flat wall (2);

a plurality of edge sections (3) integrally engaged to a periphery of said flat wall (2);

said coffer element (1) having a basically rectangular shape and having one each of four sides of said rectangular shape one of said plurality of edge sections (3) folded down from said flat wall (2);

wherein each of said plurality of edge sections (3) has an L-shaped cross-section;

said each of said plurality of edge sections (3) having, a leg (3*a*) engaged perpendicularly in relation to said flat wall (2), a first adjoining folded leg (3*b*) engaged to said leg extending parallel to said flat wall (2), and a second adjoining folded leg (3*c*) engaged to said first adjoining folded leg (3*b*) extending parallel to said leg (3*a*) and toward said flat wall (2);

said leg (3a) being longer than said first adjoining folded leg; and said first adjoining folded leg (3*b*) being longer than said second adjoining folded leg (3*c*), notch means (7) located at corners of said coffer element (1) for folding of said plurality of edge sections (3) down from said flat wall (2) and engagement of vertical supports (8);

stiffening sections (4) fastening to an underside of said flat wall (2); and said plurality of edge sections having perforations (5) and connecting holes (6).

2. A steel coffer in accordance with claim 1, wherein said connecting holes (6) are located on said leg (3*a*) to permit connection of an adjacent said coffer element (1) by means of rivets (9), screws, bolts or the like, said connecting holes (6) being in the form of a bore.

3. A steel coffer in accordance with claim 1, wherein said perforations are located on said leg (3*a*) to permit subsequent installation of ventilation, heating, water or firefighting devices and the like, said perforations being a same or optionally of a different size and shape, to accommodate said devices and the like.

4. A steel coffer in accordance with claim 1, wherein said notches extend into said flat wall (2) to allow said coffer element (1) to abut another said coffer element (1) around a support (8) engaged in notches of said notches of said coffer element and said another said coffer element in abuttment.

5. A steel coffer in accordance with claim 1, wherein in corners of said coffer element (1) where a support (8) is not used, said notches extend to a fold line where said flat wall (2) engages said leg (3*a*) to permit ends of said leg (3*a*) to abut perpendicularly to said flat wall (2) while ends of said first adjoining folded leg (3*b*) and said second adjoining folded leg (3*c*) abut along a miter joint (10).

6. A steel coffer in accordance with claim 1; wherein said stiffening sections (4) extend at a distance parallel to each other crosswise to a longitudinal direction of said coffer element (1);

said stiffening sections (4) extending over an entire width of said coffer element (1) between said plurality of edge sections (3) and having a hat-shaped or trapeze-shaped cross section;

said stiffening sections (4) being connected to said underside of said flat wall (2) by means of externally oriented fastening strips (49) and optionally to longitudinal edge sections of said plurality of edge sections.

7. A steel coffer in accordance with claim 6, wherein said stiffening sections are connected by point fusion welding (14).

8. A steel coffer in accordance with claim 6, wherein said stiffening sections are connected by resistance welding.

9. A steel coffer in accordance with claim 6 wherein said stiffening sections are connected by welding beads (15).

10. A steel coffer in accordance with claim 1 wherein said perforation (5) are in a shape of an oval or optionally elongated holes and are cut out of said longitudinal edge sections (3) below or optionally between said stiffening sections (4).

11. A steel coffer in accordance with claim 1 wherein corner braces (16) are welded into said notches (7) which close off an interior of said coffer element (1) and extend across an entire height of said coffer element and width of said notches.

* * * * *